US006935838B1

(12) United States Patent
Wang

(10) Patent No.: US 6,935,838 B1
(45) Date of Patent: Aug. 30, 2005

(54) HIGH PRESSURE MULTI-STAGE CENTRIFUGAL BLOWER

(75) Inventor: Qi Wang, Louisville, KY (US)

(73) Assignee: Hi-Bar Blowers, Inc., Fayetteville, GA (US)

( * ) Notice: Subject to any disclaimer, the term of this patent is extended or adjusted under 35 U.S.C. 154(b) by 5 days.

(21) Appl. No.: 10/391,439

(22) Filed: Mar. 19, 2003

(51) Int. Cl.[7] ..... F04D 1/00
(52) U.S. Cl. ..... 415/199.1; 415/200
(58) Field of Search ..... 415/199.1, 122.1, 415/124.1, 170.1, 171.1, 174.4, 200, 224.5, 415/111, 229

(56) References Cited

U.S. PATENT DOCUMENTS 1,998,778 A * 4/1935 Gregg ..... 415/199.1
2,760,719 A * 8/1956 Wood ..... 415/122.1
3,635,581 A * 1/1972 Nichols ..... 415/171.1
3,642,379 A * 2/1972 Swearingen ..... 415/208.3
3,734,637 A * 5/1973 Beck, Jr. ..... 415/122.1
3,756,738 A * 9/1973 Lee ..... 415/199.1
3,809,493 A * 5/1974 Pilarczyk ..... 415/199.1
4,090,813 A * 5/1978 Minato et al. ..... 416/241 R
4,099,890 A * 7/1978 Murakami et al. ..... 415/200
5,425,345 A * 6/1995 Lawrence et al. ..... 415/122.1
5,611,663 A * 3/1997 Kotzur ..... 415/122.1

* cited by examiner

*Primary Examiner*—Edward K. Look
*Assistant Examiner*—Igor Kershteyn
(74) *Attorney, Agent, or Firm*—Thomas I. Rozsa; Tony D. Chen

(57) ABSTRACT

A high pressure centrifugal blower having vertically split casing and aluminum or steel impellers mounted on a common shaft housed within the casing, and at least two oil-enclosing bearing housings to rotatably support the rotors, where an integral gearbox is formed as part of the blower casing so as to increase the impeller rotational speed to achieve higher pressure, and axial impeller eye seals are utilized to reduce the clearance and enhance reliability for higher pressure applications.

34 Claims, 6 Drawing Sheets

(PRIOR ART)

(PRIOR ART)

(PRIOR ART)

HIGH PRESSURE MULTI-STAGE CENTRIFUGAL BLOWER

BACKGROUND OF THE INVENTION

1. Field of the Invention

The present invention relates generally to the field of mechanical blowers used in industrial applications, and more particularly relates to medium speed high pressure multistage centrifugal blowers.

2. Description of the Prior Art

Centrifugal blowers are commonly used in many industrial applications. In blower terminology, 15 to 25 pound per square inch gage (psig) is generally considered relatively high pressure compared to the conventional medium pressure of 5–15 psig. Examples of common industrial applications of high-pressure capability blowers include: deep tank aeration in modern wastewater treatment plant, supplying air as an oxygen source to the combustion processes, boosting pressure of various gases, and vacuum applications as power source.

However, the pressure in 15–25 psig range is difficult to obtain in conventional direct drive multistage centrifugal blowers. This is mainly due to the low impeller rotational speed, the limitation of number of stages by rotor critical speed, and excessive leakage recycled through impeller eye which causes high discharge temperature.

As a result, many multistage centrifugal blowers are of the medium pressure type, typically having an outlet pressure between 5 to 15 psig when the inlet is at about the atmospheric pressure (blowers below 5 psig are often considered as fans, and blowers above 25 psig are often considered as compressors).

Referring to FIG. 1, there is shown at 10 a typical type of conventional centrifugal direct drive multi-stage (DDMS) blowers. DDMS centrifugal blowers are simple in construction and need little maintenance. They are reliable and low noise because of the low speed and direct drive arrangement.

As shown in FIG. 1, the conventional DDMS blower 10 has several impellers 12 arranged in series on a common shaft 14 supported by two rolling element bearings 16 at each end. Each stage consists of one of the impellers 12 mounted on the shaft 14, and a diffuser 18 followed by a return channel 20. An alternative current (AC) induction motor is typically used to directly drive the blower through a direct drive shaft 22 at 3,000 revolutions per minute (RPM) with 50 Hz power supply (or 3,600 RPM with 50 Hz power supply).

Usually several such stages are needed to obtain the required pressure, and the more stages, the higher the resulting pressure. In conventional DDMS blowers, the vertically split casing style is used to accommodate the requirement of multiple stages so that additional stages can be easily added to obtain higher pressure. However, the maximum number of stages is limited by the rotor's lateral critical speed. Since rolling element bearings are used to simplify the construction, operating speed must be 15–20% below the first critical. For this reason, aluminum impellers are used to lighten up the rotor so that more stages can be stacked to maximize the pressure gain.

Inside each stage, the compression process starts with the rotating impeller 12 where air is accelerated and pressure is raised proportional to the impeller tip velocity square. The air is then discharged into the diffuser 18 where the high-kinetically energized air is further converted into pressure. The return channel 20 then takes the decelerated air, de-swirls and guides it back to the inlet of the next stage. This process will be repeated in the following stages until the pressure reaches the desired level. However, the gas temperature is also raised in this compression process.

Because of the rising pressure across the successive stages, seals are required between the rotating impeller eye and the stationary casing to minimize the leakage losses for each stage. The effectiveness of these seals are therefore directly related to the blower efficiency and discharge temperature.

Referring to FIG. 2, there is shown the most common and economical type of impeller eye seal used in a conventional DDMS 10. As shown in FIG. 2, the impeller eye 24 is the straight labyrinth type. The labyrinth could be on the rotating impeller 12 or on stationary casing 26. The conventional impeller eye seal 28 is arranged in radial direction, where close clearances are kept between the tip of the labyrinth and opposing surface in radial direction. To minimize the leakage for a higher efficiency, especially when flow rate is relatively low, the clearance are kept as small as possible. However, the requirement of very close clearance often increases the manufacturing cost and endangers the machine because any contact with the impeller 12 will result in a machine seizure.

Additional problems exist when DDMS centrifugal blowers are used with 50 Hz power supply which is used in many countries around the world.

For example, if a blower speed is reduced by 20% (for example from 3,600 RPM with 60 Hz power supply to 3,000 RPM with 50 Hz power supply), about 20% of flow and 44% of the pressure would be lost for the same size blower. To compensate the pressure loss while maintaining direct drive arrangement, more stages have to be added. This is not only expensive but also limited by rotor lateral critical speed. Alternatively, external gearbox needs to be added to increase the blower speed. However, this arrangement is bulky in size, complicates the machine setup and maintenance, and increases the capital cost.

Another potential problem of the DDMS used in a high pressure application is caused by the commonly used radial eye seals. Since the main blower parts are vertically split in design and are interlocked together in assembly, there will be accumulated tolerance and clearance in radial direction that reduce the design clearance, which potentially may cause impeller eye seal to rub the casing which in turn causes seizure of the blower. At the same time, the thermal expansion differential between aluminum impeller and cast iron casing would further reduce the radial clearance because aluminum expands twice as much as the cast iron. This effect become worse when higher pressure is attempted because it is always accompanied by higher temperature rise that in turn causes more thermal expansion differential.

Partially to address these limitations, another type of centrifugal blower, high speed integral gear single stage (IGSS) centrifugal blowers have been developed in the past 20 years and became quite popular, especially in countries with 50 Hz power supply.

Referring to FIG. 3, there is shown at 30 a typical IGSS centrifugal blower.

As shown in FIG. 3, the IGSS centrifugal blower 30 has a single impeller 32 overhung on the high-speed pinion shaft 34 of an integral gearbox 36 that is in turn driven by an standard AC motor (not shown). To get the required pressure in a single stage compression, the impeller 32 is rotating at very high speed, typically ranges between 10,000 to 100,000 RPM. The air flow and pressure can be adjusted by changing the gear ratio.

The problems of DDMS blowers are avoided for IGSS by selecting a higher speed ratio gear set without changing the blower. The IGSS blowers are more compact and lightweight, and can also be fitted optionally with inlet guide vane (IGV) and variable diffuser vanes (VDV) to enhance the off-design-point performances.

However, the high impeller speed has to be accommodated by high-speed technologies and ultra-precision manufacturing methods.

For example, the high cost hydrodynamic bearings 40 are often needed instead of the rolling element bearings. In addition, the more costly and complicated forced oil lubrication system 42 are used instead of the simple oil splash system 44 (in FIG. 1). The high speed impeller 32 is made of high strength 5-axis milled or welded steel instead of low cost cast aluminum.

The high-speed IGSS blower 30 also generates much higher noise than a low speed DDMS 10, primarily due to the higher impeller blade loading and tip speed. The noise is of the high frequency, thus very annoying or potentially damaging to its operators nearby. For such higher level noise, the applicable regulations and standards often require a sound enclosure, which further adds to the cost and increases the difficulty in machine maintenance.

It is always desirable to provide a new design and construction of high pressure centrifugal blowers that can achieve high pressure rise and pressure ratio while overcome the problems existed in conventional centrifugal blowers.

SUMMARY OF THE INVENTION

The present invention is directed to a compact, medium speed high pressure multistage centrifugal blower that include an integral gearbox and multiple vertically stacked centrifugal stages employing the aluminum or steel impellers featuring axially oriented eye labyrinth seals.

It is an object of the present invention to provide a new and unique design and construction of a blower that can achieve higher pressure rise and pressure ratio than conventional centrifugal blowers.

It is also an object of the present invention to provide a new and unique design and construction of a high-pressure centrifugal blower that utilizes multistage impeller arrangement to achieve higher pressure rise and pressure ratio.

It is another object of the present invention to provide a new and unique design and construction of a high-pressure centrifugal blower that utilizes an integral gear box arrangement to achieve higher pressure rise and pressure ratio.

It is also another object of the present invention to provide a new and unique design and construction of a high pressure centrifugal blower that utilizes an axial labyrinth-sealing device which is less sensitive to higher temperature and longer stages for achieving higher-pressure capability without incurring higher cost.

It is still another object of the present invention to provide a new and unique design and construction of a high pressure centrifugal blower that utilizes an axial labyrinth-sealing device which operates with smaller and more predictable clearances to increase the blower efficiency and reliability.

It is an additional object of the present invention to provide a new and unique design and construction of a high pressure multi-stage centrifugal blower that is efficient, safe and reliable, that costs less for manufacturing and transportation, and that can be used with both 50 Hz and 60 Hz power supply systems.

In a preferred embodiment, the present invention is a compact sized, medium speed and high pressure blower which incorporates multiple vertically stacked centrifugal stages utilizing aluminum or steel impellers with axially oriented eye labyrinth seals, and further incorporates an integral gearbox.

The present invention has many novel and unique features and advantages. It provides a blower that can achieve higher pressure rise and pressure ratio than conventional centrifugal blowers, with multistage impeller and integral gear box arrangements, with an axial labyrinth-sealing device which has much smaller and more predictable clearances to increase the blower efficiency and reliability, and is more durable in higher temperature and longer stages environment. The present invention high pressure multi-stage centrifugal blower is compact, efficient, safe and reliable, and costs effective in manufacturing and transportation, and may be used in countries with either 50 Hz or 60 Hz power supply system.

These and further novel features and objects of the present invention will become more apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
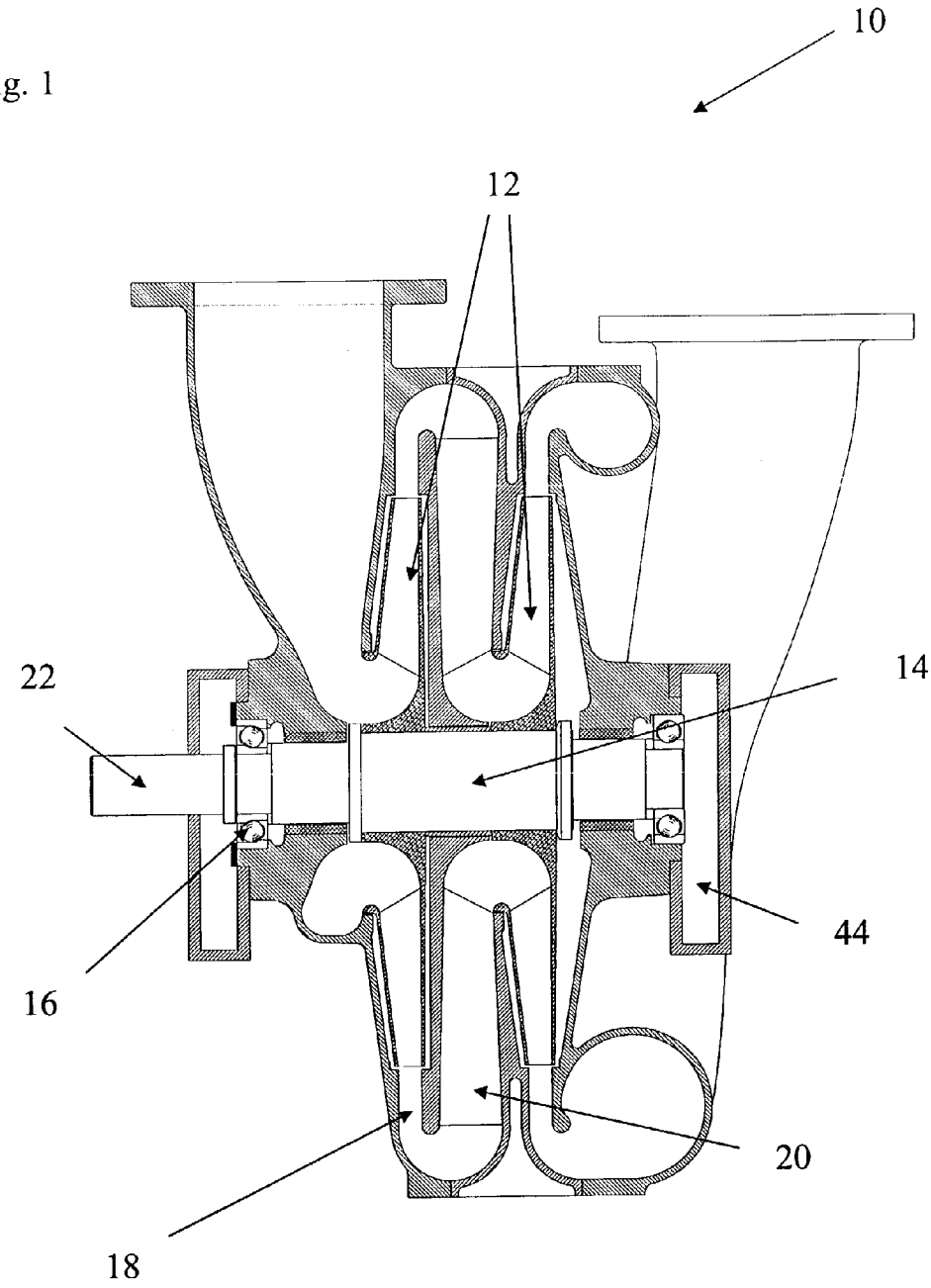
FIG. 1 (PRIOR ART) is a side cross-sectional diagram showing the main construction and features of a conventional direct drive multistage (DDMS) centrifugal blower with vertically split aerodynamic stages, rolling element bearings, radial impeller eye seals and splash lubrication.
Figure 2:
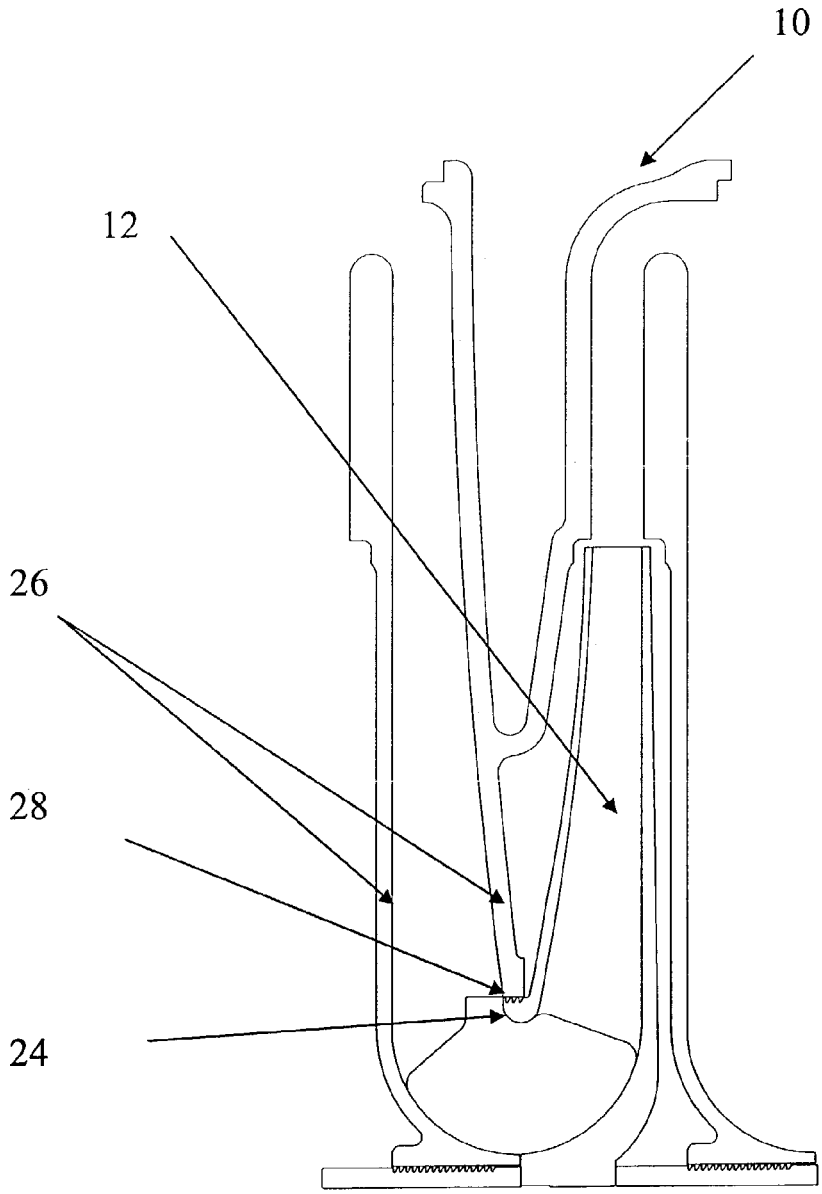
FIG. 2 (PRIOR ART) is a partial side cross-sectional diagram showing the construction and feature of a typical radial impeller eye seal used in conventional DDMS centrifugal blowers.
Figure 3:
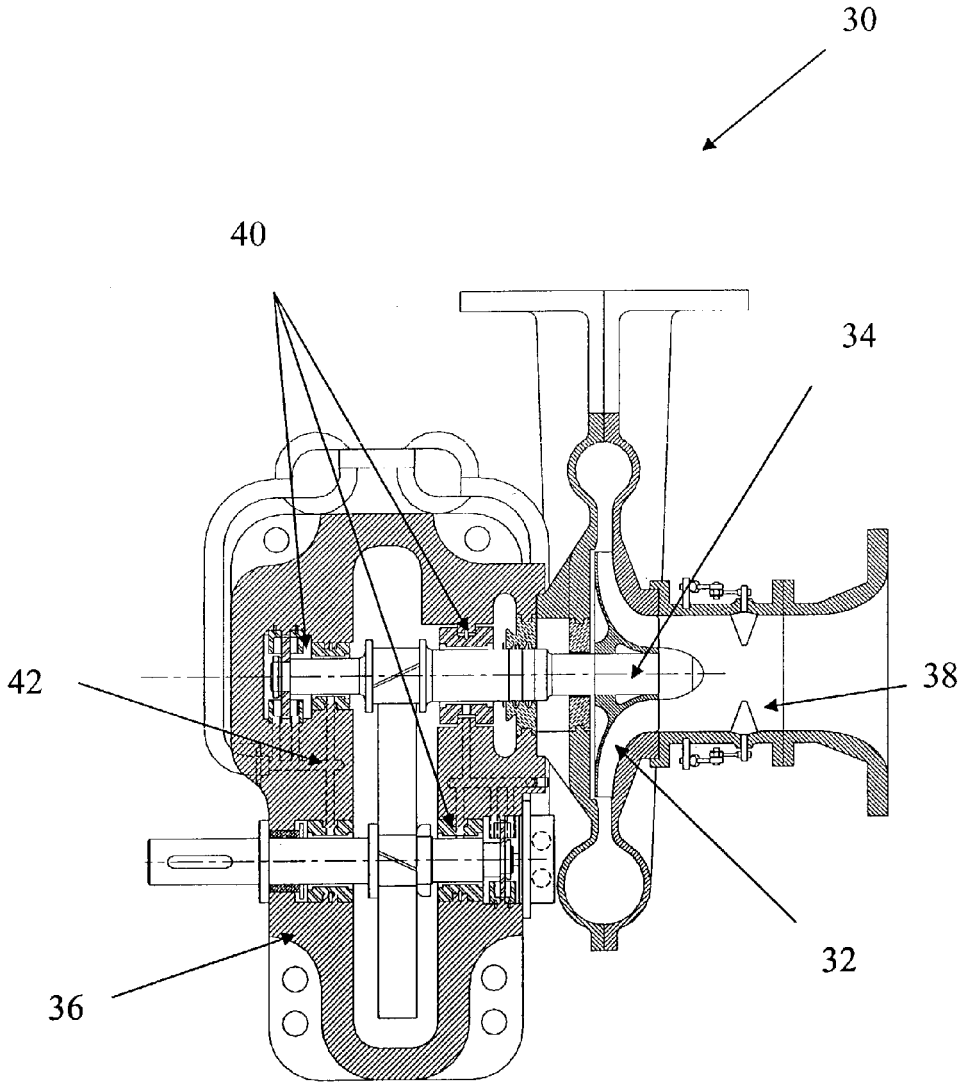
FIG. 3 (PRIOR ART) is a side cross-sectional diagram showing the construction and features of a conventional integral gear single stage (IGSS) centrifugal blower with gears, hydrodynamic bearings and forced oil lubrication.
Figure 4:
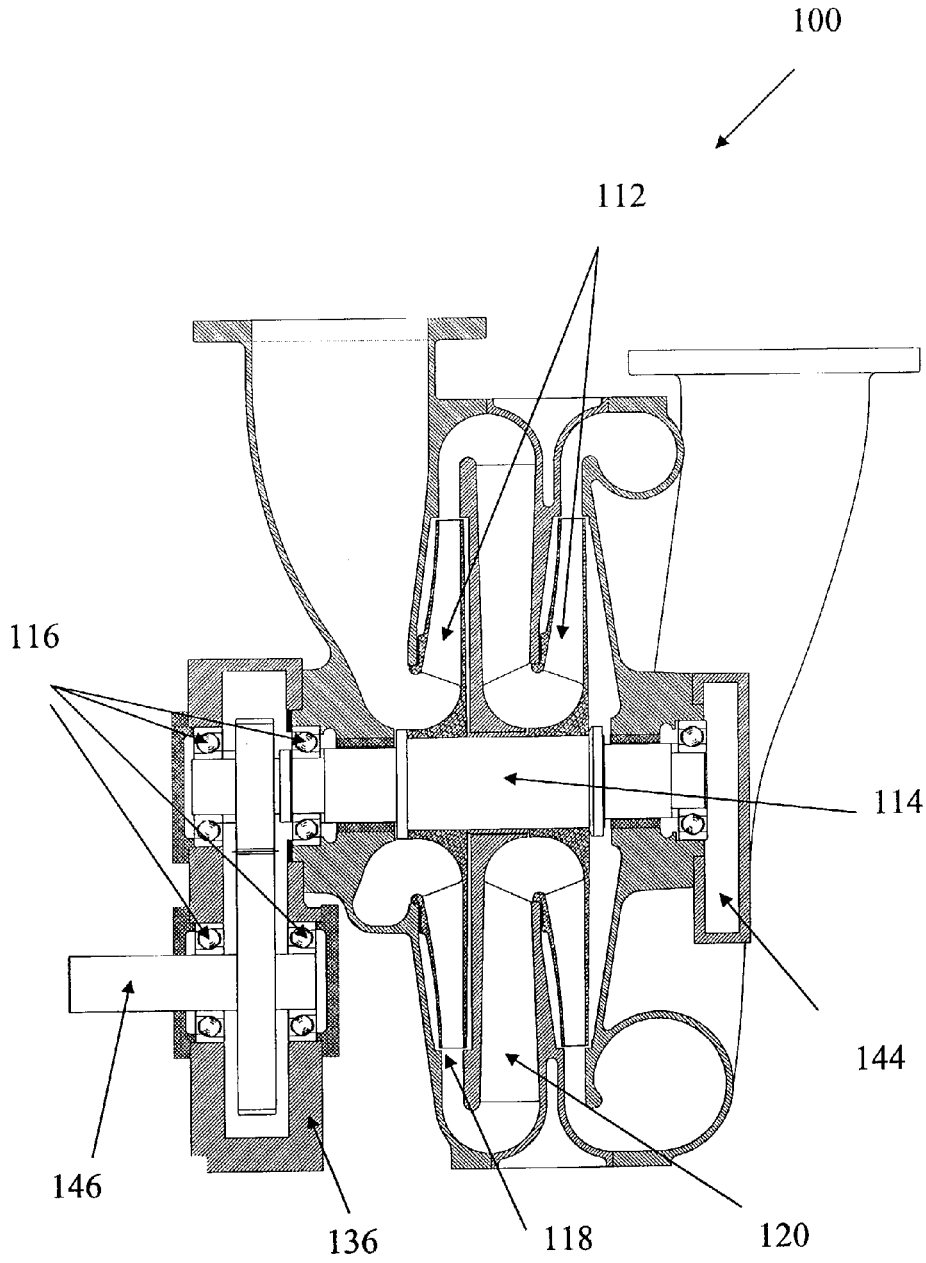
FIG. 4 is a side cross-sectional diagram showing a preferred embodiment of the present invention high pressure integral gear drive multi-stage (IGMS) centrifugal blower with a build-in gearbox and an axial impeller eye seal.

Referring to FIG. 4, there is shown at 100 a preferred embodiment of the present invention high pressure integral-gear drive multi-stage (IGMS) centrifugal blower.

As shown in FIG. 4, the present invention IGMS blower 100 has several aluminum or steel impellers 112 arranged in series on a common high-speed pinion shaft 114 supported by rolling element bearings 116 at each end. Each stage consists of one of the impellers 112 mounted on the high-speed pinion shaft 114, and a diffuser 118 followed by a return channel 120.

The present invention IGMS centrifugal blower 100 also incorporates an integral gearbox 136 which in turn can be driven by an standard AC motor (not shown) through a drive shaft 144.

The gearbox 136 of the present invention IGMS centrifugal blower is an integral part of the blower 100, which makes the blower 100 more compact and cost less than the conventional DDMS with external gearbox arrangement.

The gear ratio of the present invention high pressure IGMS centrifugal blower 100 may range from 1:1 up to 2:1 or 3:1, so that the impellers 112 can rotate considerably faster than those of the conventional DDMS. The increased impeller speed increases the pressure generated by the impellers 112, and requires fewer stages to reach the same pressure. This results in the reduction of the weight and size of the blower 100.

The higher speed capability of the present invention high pressure IGMS centrifugal blower 100 also increases the blower efficiency by utilizing more efficient backward curved impellers 112 in place of conventional less efficient radial impellers. The use of backward curved impellers 112 have a steeper performance curve, which enhances the control capability when coupled with a piping system.

To adjust for 50 Hz applications, the present invention IGMS 100 may utilize a 1.2:1 higher ratio gear, so that the impeller speed can be raised to the same level as in the 69 Hz application.

Since the speed of IGMS centrifugal blower is considerably lower than conventional IGSS blowers, standard rolling element bearings 116 and simple splash lubrication system 144 can still be utilized, and the low cost manufacturing requirements of traditional DDMS can still be applied, which result in a substantial saving in production costs as compared to the IGSS blowers.

In addition, since the impeller speed of present invention IGMS centrifugal blowers 100 is considerably lower than conventional IGSS blowers, they do not generate the high noise as the IGSS blowers do.

Another important and critical feature of the present invention high pressure IGMS centrifugal blower 100 is that it utilizes axial impeller eye seals, as compared to the radial impeller eye seals used in conventional DDMS blowers.

Figure 5:
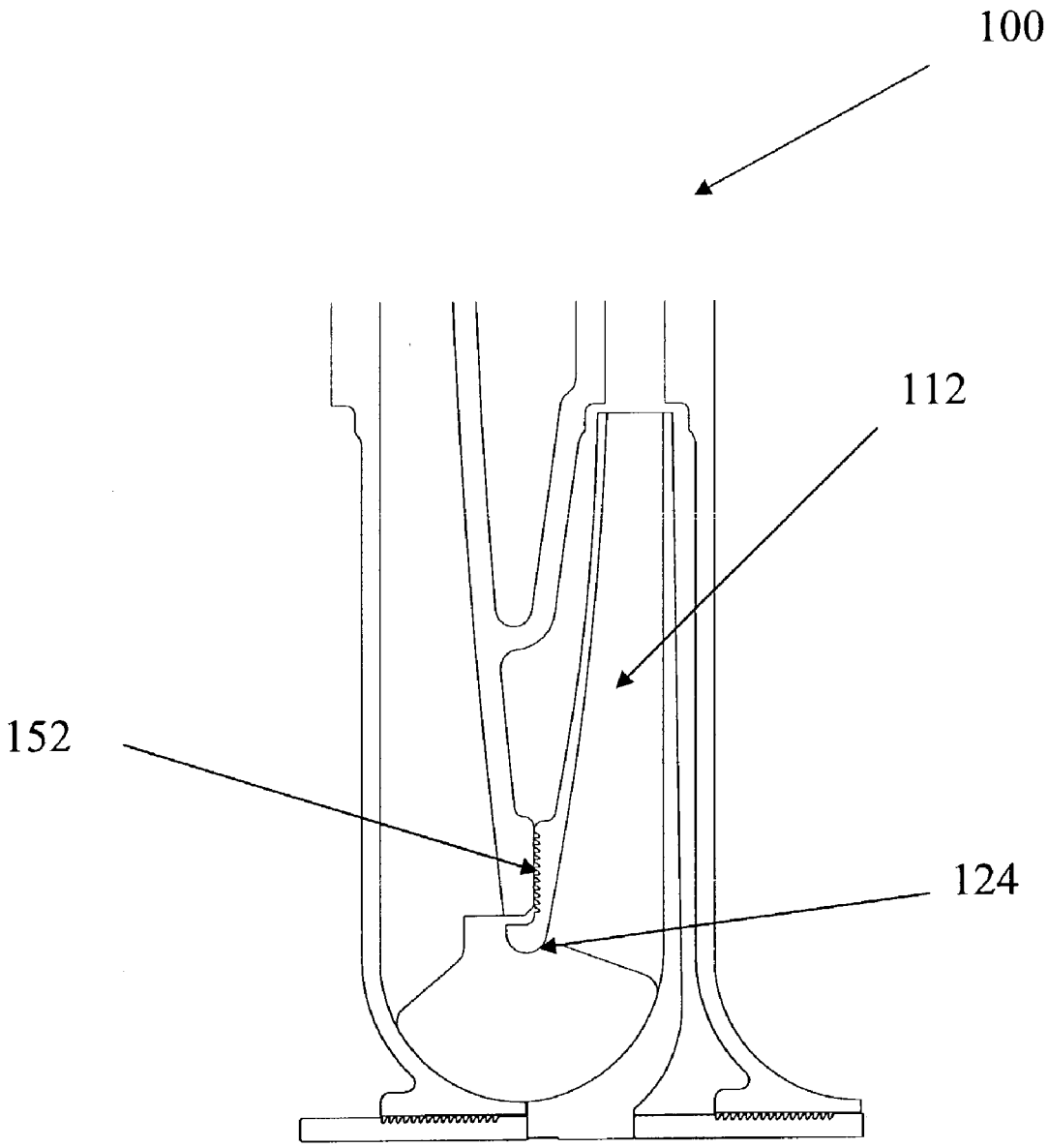
FIG. 5 a partial side cross-sectional diagram showing present invention arrangement of an axial impeller eye seal with teeth on the impeller.

Referring to FIG. 5, there is shown the axial impeller eye seal 152 with the teeth on the impeller 112.

Referring to FIG. 5, there is shown the axial impeller eye seal 152 with the teeth on the casing 126.

Figure 6:
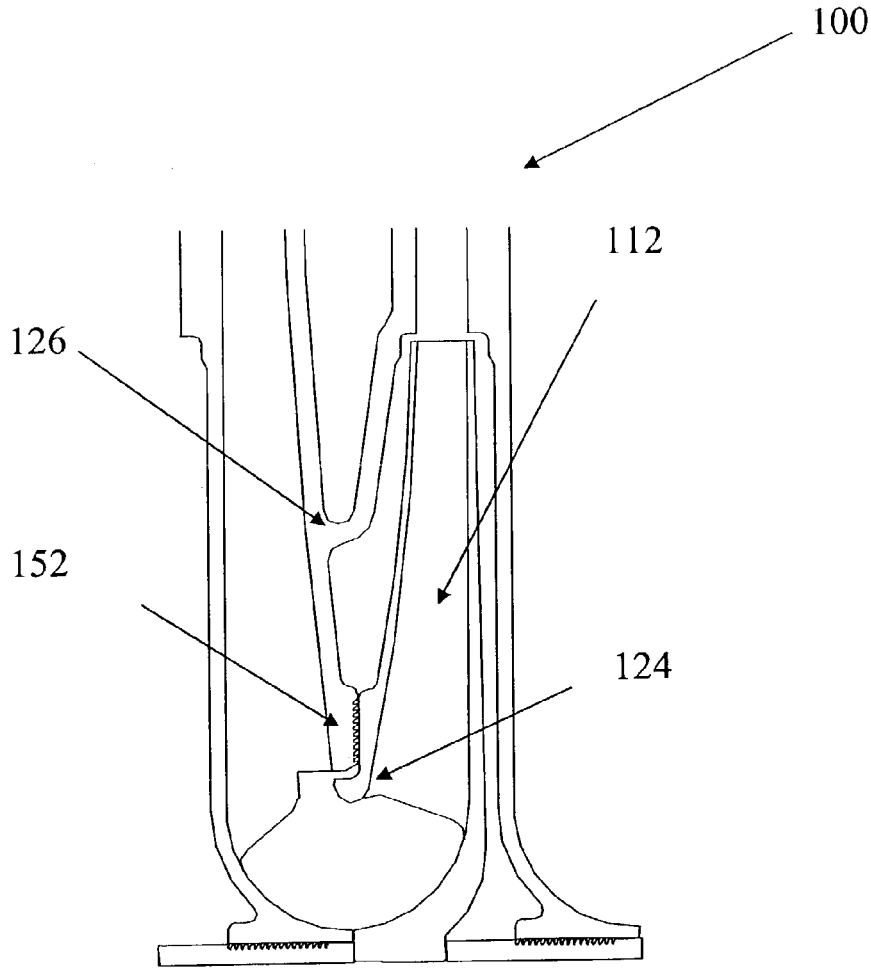
FIG. 6 a partial side cross-sectional diagram showing present invention arrangement of an axial impeller eye seal with teeth on the casing.

As shown in FIGS. 5 and 6, since the impeller eye seals are now axial (rather than radial as in the conventional blowers), the axial clearances become independent of the radial movement caused by the accumulated clearances of stacked stages and the thermal expansion differential between aluminum impeller and cast iron casing. Therefore, the blower is more capable of achieving higher pressure and has less potential contact problems for long stage machines.

Defined in detail, the present invention is a high pressure centrifugal blower, comprising: (a) a casing having a vertically split structure with an inlet port and an outlet port interconnected by internal air channels; (b) at least two stages each having a centrifugal impeller mounted on a common pinion shaft rotatably supported inside said casing structure for propelling flow from said inlet port to said outlet port and achieving higher pressure rise and higher pressure ratio therebetween; (c) an integral gear box located at one end of said pinion shaft and having a gear set with a predetermined gear ratio for transmitting rotation from a driving shaft to said pinion shaft; and (d) an axial impeller eye seal applied between an impeller eye of said impeller and said casing structure for preventing internal leakage and accidental mechanical contact.

Defined broadly, the present invention is a high pressure centrifugal blower, comprising: (a) a casing having a vertically split structure with an inlet port and an outlet port interconnected by internal air channels; (b) at least two stages each having a centrifugal impeller mounted on a common pinion shaft rotatably supported inside said casing structure for propelling flow from said inlet port to said outlet port and achieving higher pressure rise and higher pressure ratio therebetween; and (c) an integral gear box located at one end of said pinion shaft and having a gear set with a predetermined gear ratio for transmitting rotation from a driving shaft to said pinion shaft.

Alternatively defined broadly, the present invention is a high pressure centrifugal blower, comprising: (a) a casing having a vertically split structure with an inlet port and an outlet port interconnected by internal air channels; (b) at least two stages each having a centrifugal impeller mounted on a common pinion shaft rotatably supported inside said casing structure for propelling flow from said inlet port to said outlet port and achieving higher pressure rise and higher pressure ratio therebetween; and (c) an axial impeller eye seal applied between an impeller eye of said impeller and said casing structure for preventing internal leakage and accidental mechanical contact.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention.

What is claimed is:

1. A high pressure centrifugal blower, comprising:

a. a casing having a vertically split structure with an inlet port and an outlet port interconnected by internal air channels;

b. at least two stages each having a centrifugal impeller mounted on a common pinion shaft rotatably supported inside said casing structure for propelling flow from said inlet port to said outlet port and achieving higher pressure rise and higher pressure ratio therebetween;

c. an integral gear box located at one end of said pinion shaft and having a gear set with a predetermined gear ratio for transmitting rotation from a driving shaft to said pinion shaft; and d. an axial impeller eye seal applied with teeth extending in an axial direction between an impeller eye of said impeller and said casing structure for preventing internal leakage and accidental mechanical contact.

2. The high pressure blower as claimed in claim 1, wherein said axial impeller eye seal teeth are on said impeller.

3. The high pressure blower as claimed in claim 1, wherein said axial impeller eye seal teeth are on said casing structure.

4. The high pressure blower as claimed in claim 1, wherein said impeller is made of aluminum.

5. The high pressure blower as claimed in claim 1, wherein said impeller is made of steel.

6. The high pressure blower as claimed in claim 1, wherein said casing structure is made of cast iron.

7. The high pressure blower as claimed in claim 1, wherein said gear ratio is between 1:1 and 3:1.

8. The high pressure blower as claimed in claim 1, further comprising rolling element bearings for rotatably supporting said common pinion shaft inside said casing structure.

9. The high pressure blower as claimed in claim 1, further comprising a diffuser in each one of said at least two stages.

10. The high pressure blower as claimed in claim 1, further comprising a return channel in each one of said at least two stages.

11. The high pressure blower as claimed in claim 1, further comprising a splash lubrication system.

12. A high pressure centrifugal blower, comprising:

a. a casing having a vertically split structure with an inlet port and an outlet port interconnected by internal air channels;

b. at least two stages each having a centrifugal impeller mounted on a common pinion shaft rotatably supported inside said casing structure for propelling flow from said inlet port to said outlet port and achieving higher pressure rise and higher pressure ratio therebetween;

c. an integral gear box located at one end of said pinion shaft and having a gear set with a predetermined gear ratio for transmitting rotation from a driving shaft to said pinion shaft; and d. an axial impeller eye seal applied with teeth extending in an axial direction between an impeller eye of said impeller and said casing structure for preventing internal leakage and accidental mechanical contact.

13. The high pressure blower as claimed in claim 12, wherein said impeller is made of aluminum.

14. The high pressure blower as claimed in claim 12, wherein said impeller is made of steel.

15. The high pressure blower as claimed in claim 12, wherein said casing structure is made of cast iron.

16. The high pressure blower as claimed in claim 12, wherein said gear ratio is between 1:1 and 3:1.

17. The high pressure blower as claimed in claim 12, wherein said axial impeller eye seal teeth are on said impeller.

18. The high pressure blower as claimed in claim 12, wherein said axial impeller eye seal teeth are on said casing structure.

19. The high pressure blower as claimed in claim 12, further comprising rolling element bearings for rotatably supporting said common pinion shaft inside said casing structure.

20. The high pressure blower as claimed in claim 12, further comprising a diffuser in each one of said at least two stages.

21. The high pressure blower as claimed in claim 12, further comprising a return channel in each one of said at least two stages.

22. The high pressure blower as claimed in claim 12, further comprising a splash lubrication system.

23. A high pressure centrifugal blower, comprising:

a. a casing having a vertically split structure with an inlet port and an outlet port interconnected by internal air channels;

b. at least two stages each having a centrifugal impeller mounted on a common pinion shaft rotatably supported inside said casing structure for propelling flow from said inlet port to said outlet port and achieving higher pressure rise and higher pressure ratio therebetween; and c. an axial impeller eye seal applied with teeth extending in an axial direction between an impeller eye of said impeller and said casing structure for preventing internal leakage and accidental mechanical contact.

24. The high pressure blower as claimed in claim 23, wherein said axial impeller eye seal teeth are on said impeller.

25. The high pressure blower as claimed in claim 23, wherein said axial impeller eye seal teeth are on said casing structure.

26. The high pressure blower as claimed in claim 23, wherein said impeller is made of aluminum.

27. The high pressure blower as claimed in claim 23, wherein said impeller is made of steel.

28. The high pressure blower as claimed in claim 23, wherein said casing structure is made of cast iron.

29. The high pressure blower as claimed in claim 23, further comprising rolling element bearings for rotatably supporting said common pinion shaft inside said casing structure.

30. The high pressure blower as claimed in claim 23, further comprising a diffuser in each one of said at least two stages.

31. The high pressure blower as claimed in claim 23, further comprising a return channel in each one of said at least two stages.

32. The high pressure blower as claimed in claim 23, further comprising a splash lubrication system.

33. The high pressure blower as claimed in claim 23, further comprising an integral gear box located at one end of said pinion shaft and having a gear set with a predetermined gear ratio for transmitting rotation from a driving shift to said pinion shaft.

34. The high pressure blower as claimed in claim 23, wherein said gear ration is between 1:1 and 3:1.

* * * * *